United States Patent [19]

Genat et al.

[11] Patent Number: 4,719,608

[45] Date of Patent: Jan. 12, 1988

[54] ULTRA HIGH-SPEED TIME-TO-DIGITAL CONVERTER

[75] Inventors: Jean-Francois Genat, Boulogne; Francois Rossel, Noisy-le-Grand, both of France

[73] Assignee: Establissement Public styled: Centre National de la Recherche Scientifique, Paris, France

[21] Appl. No.: 732,392

[22] Filed: May 9, 1985

[30] Foreign Application Priority Data

May 11, 1984 [FR] France ..... 84 07344

[51] Int. Cl.[4] ..... G04F 8/00

[52] U.S. Cl. ..... 368/113; 368/120

[58] Field of Search ..... 368/113–120; 328/55, 61, 63, 67, 77; 377/19–20

[56] References Cited

U.S. PATENT DOCUMENTS

| | | | |
|---|---|---|---|
| 3,423,676 | 1/1969 | Tarczy-Hornoch | 324/68 |
| 3,638,047 | 1/1972 | Klein | 307/293 |
| 3,688,194 | 8/1972 | Furois | 368/120 |
| 4,164,666 | 8/1979 | Hirasawa | 307/208 |
| 4,433,919 | 2/1984 | Hoppe | 368/120 |
| 4,439,046 | 3/1984 | Hoppe | 368/120 |

FOREIGN PATENT DOCUMENTS

| | | | |
|---|---|---|---|
| 2263824 | 7/1973 | Fed. Rep. of Germany | 368/120 |
| 2088363 | 1/1972 | France . | |
| 729931 | 5/1955 | United Kingdom | 368/120 |
| 402853 | 10/1973 | U.S.S.R. | 368/120 |

OTHER PUBLICATIONS

"IEEE Transactions on Nuclear Science", vol. NS-6, No. 1, Mar. 1959, pp. 31–34.

*Primary Examiner*—Vit W. Miska

*Attorney, Agent, or Firm*—Weingarten, Schurgin, Gagnebin & Hayes

[57] ABSTRACT

A chain of gates is formed on one and the same substrate of integrated circuit to enable the propagation along the chain of a starting signal received at one end of the chain, and a locking circuit formed for example by another chain of gates has outputs connected to the gates of the chain in order to be able to block the state thereof following the reception of a stop signal, so that the number of gates gone through by the starting signal is a linear function of the time elapsed between the reception of the starting signal and the reception of the stop signal.

9 Claims, 3 Drawing Figures

ULTRA HIGH-SPEED TIME-TO-DIGITAL CONVERTER

Figure 1:
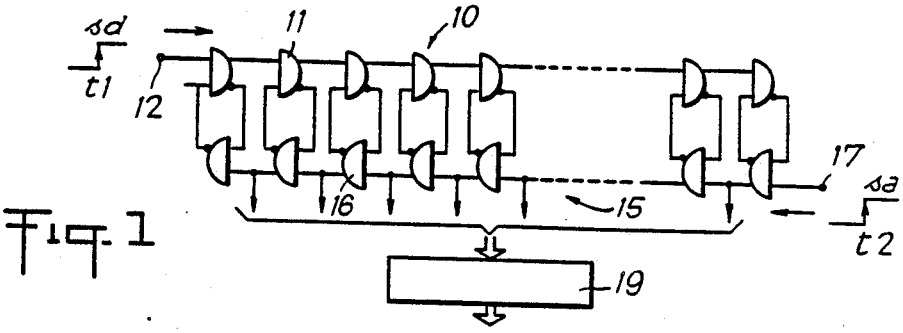

The present invention relates to a time-to-digital converter, namely a device designed to give a digital value representing the time elapsed between the reception of a starting signal and the reception of a stop signal.

The invention finds an application, in particular but not exclusively, for mesuring very short periods of time in nuclear electronics : high energies physics, nuclear physics or nuclear medecine. By way of example, the converter according to the invention is particularly suitable for measuring pick-up time intervals at the ends of particle detectors.

The known time-to-digital converters are essentially of two types. The first type uses a capacitor which is charged with continuous current throughout the time period to be measured, the charging level being thereafter digitized; said converters are generally accurate, but of complex structure. The second type is based on the use of reference clocks; these converters are also of complex structure and their accuracy is linked to that of the clock.

It is the object of the present invention to propose a time-to-digital converter of simple structure, permitting its production in integrated circuit form. It is also an object of the invention to propose an ultrahigh speed time-to-digital converter, namely with very brief response time.

These objects are reached with a converter which, according to the invention, comprises :

- a chain of gates formed on one and the same integrated circuit substrate to allow propagation through the chain of a starting signal received at one end of said chain, and
- a locking circuit with outputs connected to the gates of the chain such as to be able to lock the state thereof upon receipt of a stop signal, so that the number of gates gone through by the starting signal is a linear function of the time which has elapsed between the time when a starting signal is received and the time when a stop signal is received.

The present invention is based on the use as time-division reference, of times of propagation of logic signals in an integrated circuit. Indeed, the new technologies in integrated circuits, and in the present case the production of prediffused logic gates arrays, ensure, inside one and the same sample, scatterings of several percent on logic gate assemblies of several thousands units.

The measurement is achieved by inhibiting, following the receipt of the stop signal, the propagation of the starting signal through a chain of gates.

Said inhibiting may be performed in several ways.

According to a preferred embodiment of the invention, the locking circuit comprises a second chain of gates which is formed on the same integrated circuit substrate and at one end of which is received the stop signal, the two chains forming parallel paths with links between the gates of the first chain and the gates of the second chain so that the state of the gates of at least one of the two chains is locked when the starting signal propagating along the first chain and the stop signal propagating along the second chain have met. The configuration of the gates of the first chain, and also that of the gates of the second chain is representative of the time interval to be measured. To this end, the converter is provided with coding means having inputs connected with the gates of at least one of the chains, to supply, a digital measuring value which is a function of the condition of said gates.

The directions of propagation of the starting signal and of the stop signal along the two parallel chains may be opposite or identical. In this latter case, the time of propagation through the gates of the first chain is greater than the time of propagation through the gates of the second chain, in order to allow the stop signal to "catch up with" the starting signal.

According to another embodiment of the invention, the locking circuit comprises a plurality of paths, each one formed between a commun input receiving the stop signal and a respective gate of the starting signal propagation chain. In this case, the stop signal is applied in quasi-simultaneous manner to the different gates so that the state of the chain is set as soon as the stop signal is received. Means for reading the state of the gates of the starting signal propagation chain are provided in order to give a digital value representing the time interval to be measured.

Whatever the case, the converter according to the invention enables to give, ultra-rapidly, the results from measurements of very brief times. One added advantage resides in that the converter can be produced in integrated circuit form.

Figure 2:
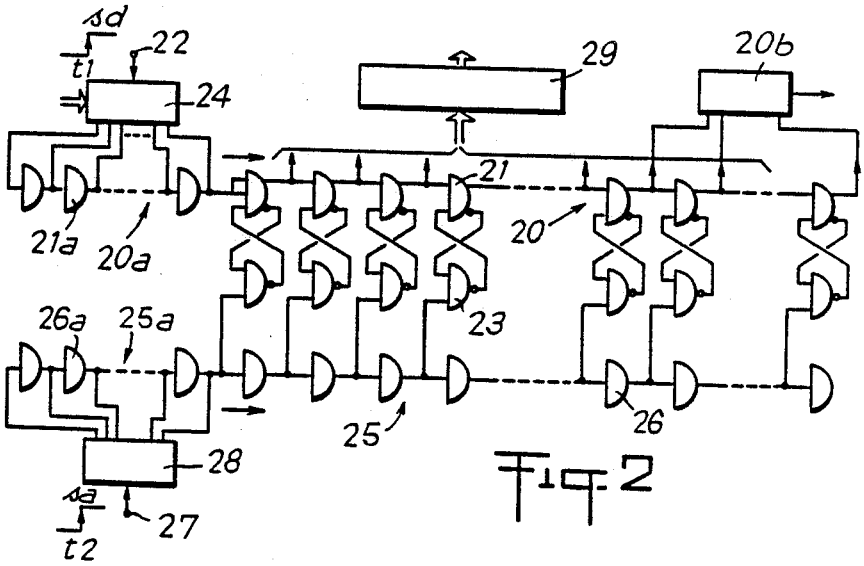
Figure 3:
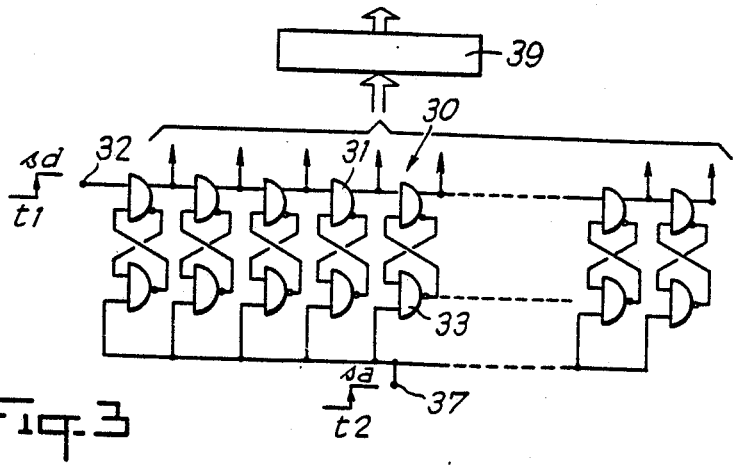

The invention will be more readily understood on reading the following description with reference to the accompanying drawings in which :

FIG. 1 is a diagram of a time-to-digital converter according to a first embodiment of the invention, FIG. 2 is a diagram of a time-to-digital converter according to a preferred embodiment of the invention, and FIG. 3 is a diagram of a time-to-digital converter according to yet another embodiment of the invention.

Referring first to FIG. 1, this shows a converter which comprises two chains of similar gates 10 and 15, formed in parallel but with opposite propagation directions. The gate chains are formed from a prediffused logic gates array on one and the same integrated circuit substrate.

Each gate 11 of chain 10 has a first input connected with a non-inverting output of the preceding gate 11 and a second input connected to the inverting output of an associated gate 16 of chain 15. Said latter gate has a first input connected to the non-inverting output of the preceding gate 16 and a second input connected to the inverting output of the associated gate 11. To each gate 11 is thus associated a gate 16, and vice versa. It will be noted that the term "gate" is used here to designate a logic circuit through which an incoming signal may or may not be propagated, depending on the state of a control signal which may also be received by said circuit.

A starting signal sd is applied to the input end 12 of the chain of gates 10 for example in the form of a change from a low logic level to a high logic level at a time t1. A stop signal is applied to the input end 17 of the chain of gates 15 also in the form of a transition from low logic level to high logic level at a time t2. Inputs 12 and 17 are situated at opposite ends of chains 10 and 15, signals sd and sa propagating in opposite directions. Each time that a signal sd goes through a gate 11, the corresponding gate 16 is locked. In the same way, each time that a signal sa goes through a gate 16, the corresponding gate 11 is locked. The meeting up of signals sd and sa takes place in such a point that the number of gates traversed by one of them is a linear function of the sought time $\Delta t = t2 - t1$. The state of the gates after the meeting of the two signals is set. It can be read immediately on the outputs of the gates of one of the chains, for example on the non-inverting outputs of gates 16, these being connected to a coding circuit 19. When designating by M the total number of gates in each chain, by m the number of gates 11 traversed by the starting signal, and by $t_{pd}$ the propagation time through one gate, what is obtained is $\Delta t = t_{pd}(2\,m - M)$. The coding circuit may be designed to deliver directly a binary numeric word giving on N bits a value proportional to $\Delta t$.

The low significance bit of the word supplied by the converter is worth 2 $t_{pd}$. For an N-bits converter of which the bit of lowest significance is worth $\sigma t$ and with an absolute accuracy equal to half said lowest significance, the dispersion $\sigma t_{pd}$ of the propagation time through every integrated circuit gate should meet the condition.

$$\sigma_{pd} < \delta t / 2^{N/2 \pm 2} \quad (1)$$

It is also possible to show that, for a given scattering, the maximum number N of significant bits which the converter can supply, is such that :

$$N \leqq \tfrac{1}{3}(2 \log_2 (T/t_{pd}) - 4),$$

T being the value of the full scale of the converter. The value of the lowest significant bit is here equal to 2 $t_{pd}$. A reduction of said value in order to improve accuracy of fineness of the measurement, requires a reduction of the time of propagation through every gate.

FIG. 2 illustrates another embodiment of a converter according to the invention in which the least significant bit has a value which may be less than the time of propagation through one gate.

The starting signal sd is applied to the input end 22 of a first chain 20 of gates 21 similar to chain 10 of the converter according to FIG. 1. The stop signal sa is applied to the input end 27 of a second chain 25 of transmission gates 26.

Every gate 26 is designed to systematically transmit the signal appearing on its signal input, said input being connected to its control input. Every input of a gate 26 is connected to an input of a gate 23 of which the inverting output is connected to an input of an associated gate 21. The other input of said gate 21 being connected to the non-inverting output of the preceding gate 21, whereas the other input of gate 23 is connected to the inverting output of the associated gate 21. Thus, a gate 26 is associated to every couple of gates 21–23.

Starting signal sd is applied to the input 22 at time t1 and is propagated along chain 20. It will be noted that everytime signal sd goes through a gate 21, the associated gate 23 is locked. Stop signal sa is applied to the input 27 at time t2 and is propagated along chain 25. The propagation along said chain is faster than the propagation along chain 20 so that signal sa can catch up with the starting signal. As soon as signal sa meets up with an unlocked gate 23, it goes right through it in order to lock the corresponding gate 21, thus blocking the propagation of the starting signal. Signal sa continues to be propagated along chain 25, successively blocking the gates of the chain 20 which have not been traversed by the starting signal. The state of the gates of chain 20 is a linear function of $\Delta t = t2 - t1$. It can be immediately read on the non-inverting outputs of gates 21, these being connected to a coding circuit 29. When designating by m the number of gates 21 traversed by the starting signal, by $t1_{pd}$ the propagation time through every gate of chain 20 and by $t2_{pd}$ the propagation time through every gate of chain 25, what is obtained is $\Delta t = m\,(t1_{pd} - t2_{pd})$. Coding circuit 29 may be designed so as to supply the number m in the form of a binary numeric word.

The propagation time through the gates of one chains is dependent on several factors : number of gates connected in output of every gate of the chain, lengths of the connections between gates, circuit supply voltage, . . . . In the present case, it is possible to use one or more of these factors to have different propagation times $t1_{pd}$ and $t2_{pd}$ such as for example $t1_{pd} > t2_{pd}$. The chain of gates 21 could be placed with the associated gates 23 on an integrated circuit substrate and the chain of gates 26 on another substrate. But preferably, the gates 21, 23, 26 are formed from a prediffused logic gates array on one and the same substrate and the propagation time difference is obtained by acting on the number of gates connected to every gate of one chain and on the connection lengths.

The least significant bit of the word supplied by the converter is worth $t1_{pd} - t2_{pd}$; therefore it can take on a value less than $t1_{pd}$ and $t2_{pd}$. Concerning scatterings $\sigma t1_{pd}$ and $\sigma t2_{pd}$ on the propagation times, the condition (1) is still valid with :

$$\sigma_{pd} = (\sigma t1^2_{pd} + \sigma t2^2_{pd})^{\frac{1}{2}},$$

as well as the relation (2) which gives the number of bits N.

Currently available prediffused logic gates arrays have propagation times per gate, which are below a nanosecond and scatterings less than a few scores of picoseconds. By way of indication, the converter shown in FIG. 2 enables, in the above circumstances, a coding on five bits with a least significant bit corresponding to 500 ps and a full scale of 16 ns. Moreover, and this is one advantage that all the embodiments of the invention have in common, the result is instantly available.

FIG. 2 also illustrates the means used to adjust the converter.

For the setting to zero, a succession of transmission gates **20*a*, 25*a* respectively is connected upstream of every chain 20, 25. The starting signal is applied to an input terminal 22*a* which is connected to the input of a switching circuit 24 of which the outputs are connected to respective inputs of gates 21*a* of the succession 20*a*. In like manner, the stop signal is applied on one input terminal 27*a* which is connected to the input of a switching circuit 28 of which the outputs are connected to respective inputs of the gates 26*a* from the succession of gates 25*a*. Every switching circuit has a control input permitting to select one of the outputs. The zero setting is adjusted by positioning the switching circuits in such a way that the converter response is equal to zero when signals sd and sa are applied simultaneously to terminals 22*a* and 27*a***.

For the full scale adjustment, a decoding circuit **20*b* is placed at the end of the chain 20 which is at the opposite of the input end, said decoding circuit 20*b* having inputs connected to the non-inverting outputs of several gates 21. The converter operating on N bits, chain 20 comprises at least 2N gates 21. In fact the number of gates 21 is selected to be slightly greater than 2N, for example equal to 2N+k and the decoding circuit 20b receives the outputs of the 2k+1 last gates of the chain. As indicated hereinabove, the time of propagation through every gate, here $t1_{pd}$, is dependent on the magnitude of the supply voltage for the integrated circuit. This is the reason why the decoding circuit 20b is used for supplying a value of control of the adjustment of the supply voltage so that the full scale be reached just when two reference signals sd and sa are applied with a time interval equal to the full scale, the coding circuit 29 being connected to the 2N first gates of chain 21**.

It will be noted that several alternated adjustments of the zero setting and of the full scale setting may be necessary.

The case considered hereinabove is the case where the propagation of the starting signal through a chain of gates is stopped when caught up by the propagation of the stop signal in another chain of gates.

FIG. 3 illustrates another embodiment of the converter according to the invention in which the propagation of the starting signal through a chain of gates is stopped by the parallel blocking of the gates in the chain in response to the reception of a stop signal.

Starting signal sd is received on the input end 32 of a chain 30 of gates 31 whereas the stop signal sa is applied to a terminal 37 in parallel with the first inputs of gates 33, each one of which is associated to a respective gate 31. The connections between gates 31 and 33 are identical to the connections between gates 21 and 23 of the converter according to FIG. 2, gates 31 and 33 being formed on one and the same substrate of integrated circuit from a prediffused logic gates array.

Everytime signal sd goes through every gate 31, the associated gate 33 is blocked. The stop signal goes through still unblocked gates 33 in order to block the associated gates 31 and thus stop the propagation of signal sd. The state of the gates of chain 30 is a linear function of the time interval $\Delta t$ separating times t1 and t2 of reception of signals sd and sa. Said states is directly read on the non-inverting outputs 31 and converted to a numeric word form by way of a coding circuit 39.

The bit of lowest significance $\sigma t$ of the word supplied by the converter is worth $t_{pd}$, namely the time of propagation through every gate of the chain 30. For an N bits converter of accuracy equal to half the lowest significance, the scattering $\sigma t_{pd}$ of the propagation time $$t_{pd} < \sigma t / 2^{(N+3)} \quad (3).$$

It will be noted that said condition is less significant by a factor $2^{\frac{1}{2}}$ than condition (1) due to the fact that there is only one propagation in only one chain. Extra scattering however is introduced due to the fact that the blocking of gates 31 of chain 30 cannot be exactly simultaneous.

We claim:

1. An ultra-high speed time-to-digital converter, comprising:

a first input terminal for receiving a start signal;

a plurality of gate circuits connected in cascade to form a chain having one end connected to the first input terminal to allow the propagation of the start signal through said chain, all of said gate circuits being constituted by the same integrated circuit devices formed on one and the same semiconductor substrate to show a substantially uniform signal propagation time, and each gate circuit having a signal input, a signal output and a control input, said signal output having a first state when the start signal has propagated through the corresponding gate circuit and a second state different from the first state when the start signal has not propagated through the corresponding gate circuit;

a second input terminal for receiving a stop signal; and locking circuit means having an input connected to the second input terminal and a plurality of outputs each connected to the control input of a respective gate circuit of said chain, said locking circuit means acting in response to the reception of a stop signal to lock the gate circuits through which the start signal has not yet propagated, whereby the number of gate circuits gone through by the start signal is a linear function of the time elaspsed between the time when a start signal is received and the time when a stop signal is received.

2. An ultra-high speed time-to-digital converter, comprising:

a first input terminal for receiving a start signal;

a plurality of first gate circuits connected in cascade to form a first chain having one end connected to the first input terminal to allow the propagation of the start signal through said first chain, all of the said first gate circuits being constituted by the same integrated circuit devices formed on one and the same semiconductor substrate to shown a substantially uniform first signal propagation time, and each first gate circuit having a signal input and a signal output, the latter having a first state when the start signal has propagated through the corresponding first gate circuit and a second state different from the first state when the start signal has not propagated through the corresponding first gate circuit;

a second input terminal for receiving a stop signal;

a plurality of second gate circuits connected in cascade to form a second chain having one end connected to the second input terminal to allow the propagation of the stop signal through said second chain, all of said second gate circuits being constituted by the same integrated circuit devices formed on one and the same semiconductor substrate to show a substantially uniform second signal propagation time, and each gate circuit having a signal input and a signal output, the latter having a first state when the stop signal has propagated through the corresponding second gate circuit and a second state different from the first state when the stop signal has not propagated through the corresponding second gate circuit;

a plurality of locking circuit means each connected between a respective first gate circuit and a respective corresponding second gate circuit so as to have the state of the signal outputs of all the gate circuits in at least one of said first and second chains locked when the start signal and the stop signal propagating along the parallel paths constituted by said first and second chains simultaneously reach corresponding first and second gate circuits; and coding means connected to the signal outputs of the gate circuits of said at least one chain to provide digital information which is a function of the locked state of said signal outputs.

3. A converter as claimed in claim 2, wherein said first and second gate circuits are fomed on one and the same semiconductor substrate.

4. A converter as claimed in claim 2, wherein the directions of propagation of the start signal and of the stop signal along the parallel paths formed by the first and second chains are oppsite to one another.

5. A converter as claimed in claim 4, wherein each one of said first and second gate circuits has a control input; and each one of said locking circuit means includes a first connecting circuit connecting an output of the corresponding first gate circuit to the control input of the corresponding second gate circuit and a second connecting circuit connecting an output of the corresponding second gate circuit to the control input of the corresponding first gate circuit so as to control the locking of a gate circuit in one chain in response to the change of the signal output of the corresponding gate circuit in the other chain from the first to the second state.

6. A converter as claimed in claim 2, wherein the directions of propagation of the start signal and of the stop signal along the parallel paths formed by the first and second chains are identical, said first propagation time being longer than said second propagation time.

7. A converter as claimed in claim 4, wherein each one of said first gate circuits has a control input; and each one of said locking circuit means includes a third gate circuit having a signal input connected to a signal output of the corresponding first gate circuit and a signal output connected to the control input of the corresponding first gate circuit in response to the change of the signal output of the corresponding second gate circuit from the first to the second state only when the signal output of the first gate circuit is still in the first state.

8. An ultra-high speed time-to-digital converter, comprising:

a first input terminal for receiving a start signal;

a plurality of gate circuits connected in cascade to form a chain having one end connected to the first input terminal to allow the propagation of the start signal through said chain, all of said gate circuits being constituted by the same integrated circuit devices formed on one and the same semiconductor substrate to shown a substantially uniform signal propagation time, and each gate circuit having a signal input, a signal output and a control input, said signal output having a first state when the start signal has propagated through the corresponding gate circuit and a second state different from the first state when the start signal has not propagated through the corresponding gate circuit;

a second input terminal for receiving a stop signal;

a plurality of locking circuit means each having a signal input connected to said second input terminal to receive the stop signal and a signal output connected to the control input of the corresponding respective gate circuit, said locking circuit means acting in response to the reception of a stop signal by locking the state of the signal outputs of said gate circuits; and coding means connected to the signal outputs of said gate circuits to provide a digital information which is a function of the locked state of said signal outputs.

9. A converter according to the claim 8, wherein each of said locking circuit means includes gate means having a signal input connected to the second input terminal, a control input connected to a signal output of the corresponding gate circuit and a signal output connected to the control input of the corresponding gate circuit so as to control the locking of the corresponding gate circuit in response to the reception of the stop signal only when the signal output of the corresponding gate circuit is still in the first state.

* * * * *

UNITED STATES PATENT AND TRADEMARK OFFICE

CERTIFICATE OF CORRECTION

PATENT NO. : 4,719,608

DATED : January 12, 1988

INVENTOR(S) : Jean-Francois Genat; Francois Rossel

It is certified that error appears in the above-identified patent and that said Letters Patent is hereby corrected as shown below:

Column 1, line 10, "mesuring" should read --measuring--
line 12, "medecine" should read --medicine--

Column 3, line 15, "$\sigma t$" should read --$\delta t$-- line 20, "$\sigma_{pd} < \delta t/2^{N/2 \pm 2}(1)$" should read --$\sigma^{t}_{pd} < \sigma t/2^{N/2+2}(1)$--

Column 4, line 8, "one chains" should read --one chain-- line 30, "$\sigma_{pd} = (\sigma t1^{2}_{pd} + \sigma t2^{2}_{pd})^{1/2}$" should read --$\sigma^{t}_{pd} = (\sigma t1^{2}_{pd} + \sigma t2^{2}_{pd})^{1/2}$--

Column 5, line 42, "$\sigma t$" should read --$\delta t$--

Column 7, line 7, "oppsite" should read --opposite--
Column 8, line 29, "to the claim" should read --to claim--

Signed and Sealed this

Thirteenth Day of June, 1989

*Attest:*

*Attesting Officer*

DONALD J. QUIGG

*Commissioner of Patents and Trademarks*